US007329838B2

(12) United States Patent
Song et al.

(10) Patent No.: US 7,329,838 B2
(45) Date of Patent: Feb. 12, 2008

(54) CONVECTION PART FOR ELECTRIC OVEN RANGE

(75) Inventors: Sung Ho Song, Gyeongsangnam-do (KR); Sang Ik Lee, Gyeongsangnam-do (KR); Yoon Seob Eom, Gyeongsangnam-do (KR); Dae Hyun Kim, Gyeongsangnam-do (KR); Moo Yeon Choi, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/199,218

(22) Filed: Aug. 9, 2005

(65) Prior Publication Data

US 2006/0027560 A1 Feb. 9, 2006

(30) Foreign Application Priority Data

Aug. 9, 2004 (KR) ..... 10-2004-0062371
Oct. 21, 2004 (KR) ..... 10-2004-0084285

(51) Int. Cl.
*A21B 1/00* (2006.01)

(52) U.S. Cl. ..... 219/400; 219/449.1; 126/21 A; 126/21 R; 126/273 A; 99/330; 99/331

(58) Field of Classification Search ..... 219/400, 219/449.1; 126/21 A, 21 R, 273 A; 99/468, 99/330, 331
See application file for complete search history.

(56) References Cited

U.S. PATENT DOCUMENTS 2,461,318 A * 2/1949 Folli ..... 219/400
5,121,737 A * 6/1992 Yencha, III ..... 126/21 A
5,468,935 A * 11/1995 Wang ..... 219/400
5,497,760 A * 3/1996 Alden et al. ..... 126/21 A
5,655,511 A * 8/1997 Prabhu et al. ..... 126/21 A
5,747,775 A * 5/1998 Tsukamoto et al. ..... 219/400
6,084,214 A * 7/2000 Tallman et al. ..... 219/400
6,730,881 B1 * 5/2004 Arntz et al. ..... 219/400

FOREIGN PATENT DOCUMENTS

JP 09126465 A * 5/1997

* cited by examiner

*Primary Examiner*—J. Pelham
(74) *Attorney, Agent, or Firm*—Birch, Stewart, Kolasch & Birch, LLP

(57) ABSTRACT

A convection part of an electric oven range is provided. In the convection part, a convection motor is provided, a convection fan is connected with the convection motor, and a fan housing encloses the convection fan and it includes at least one pair of discharge ducts in opposite directions.

30 Claims, 7 Drawing Sheets

CONVECTION PART FOR ELECTRIC OVEN RANGE

BACKGROUND OF THE INVENTION

1. Field of the Invention

The present invention relates to an electric oven range, and more particularly, to a convection part for an electric oven range.

2. Description of the Related Art

An electric oven range is a cooking device that has a plurality of heaters generating heat from electricity to cook food. An electric oven range is a kind of a combined kitchen appliance that includes an oven function for cooking food in a closed space using heat generated from a heater and a range function for cooking food by applying heat directly to a food container placed on a top surface.

Electric oven ranges can heat both the inside and outside of food, such that they can cook food faster than gas oven ranges. Also, since electric oven ranges use electricity to generate heat, they provide a safer way of cooking and higher efficiency in using generated heat. Therefore, electric oven ranges are being more widely used.

An electric oven range includes a convection part for drawing air form an oven cavity, heating the air to a specific temperature, and discharging the heated air again to the oven cavity. This air circulation is caused by a convection fan installed in the convection part. Also, the convection part includes an air intake and an air outlet to allow the airflow.

However, since the convection part includes a plurality of air outlets around the outer wall of the convection part, the sizes of the air outlets are relatively small. Thus, air is not smoothly discharged from the convection part through the small air outlets. This decreases heat convection in the oven cavity to cause non-uniform heat distribution in the oven cavity. Therefore, food is heated non-uniformly and more time is required to cook food.

SUMMARY OF THE INVENTION

Accordingly, the present invention is directed to a convection part of an electric oven range that substantially obviates one or more problems due to limitations and disadvantages of the related art.

An object of the present invention is to provide a convection part of an electric oven range, which has an improved structure for smooth airflow.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a convection part of an electric oven range, the convection part including: a convection motor; a convection fan connected with the convection motor; and a fan housing enclosing the convection fan and including at least one pair of discharge ducts in opposite directions.

In another aspect of the present invention, there is provided a convection part of an electric oven range provided with an oven cavity in which food is cooked and the convection part at a rear side of the oven cavity, the convection part including: a convection motor generating rotary motion from supplied electricity; a convection fan rotated by the rotary motion to circulate air and including a plurality of fan blades formed by bending a portion of the convection fan; and a fan housing enclosing the convection fan and including at least one pair of discharge ducts to discharge air.

In a further another aspect of the present invention, there is provided a convection part of an electric oven range, the convection part including: a convection fan; a fan housing enclosing the convection fan; and a discharge duct formed at the fan housing.

According to the present invention, air can smoothly flow into and from the convection part, such that food can be uniformly cooked in the oven cavity with less time and increased efficiency.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
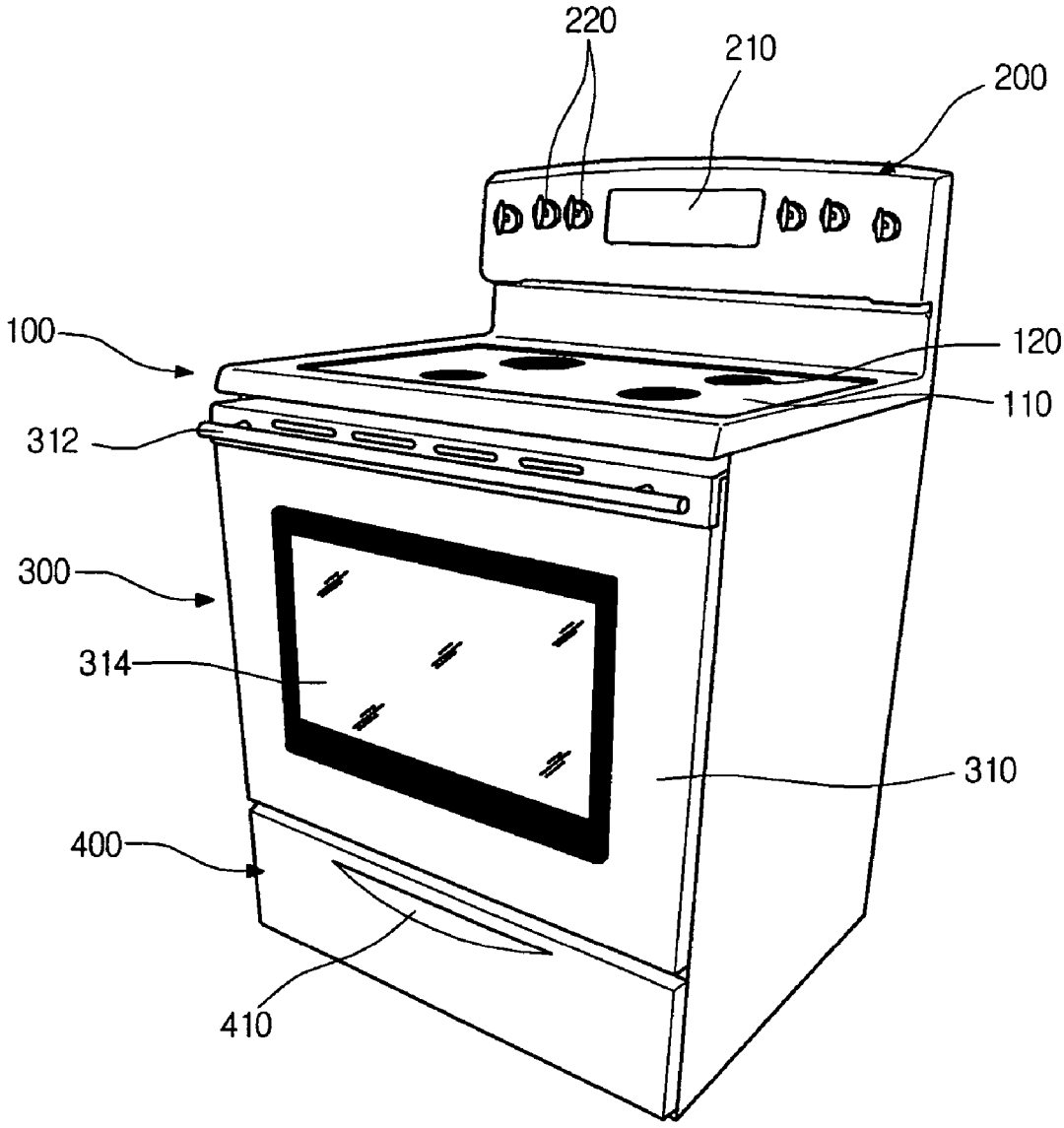
FIG. 1 is a perspective view of an electric oven range employing a convection part according to the present invention.

FIG. 1 is a perspective view of an electric oven range employing a convection part according to the present invention.

Referring to FIG. 1, an electric oven range includes a top burner part 100 on a top to cook food in a general way. A food container filled with food is placed on a burner (described below) of the top burner part 100, and heat is radiated from the burner 120 to the food container. The radiated heat is conducted through the food container to the food to cook the food. When cooking food using the top burner part 100, cooking state of the food can be easily seen.

The top burner part 100 includes a top plate 110 on a top surface. The top plate 110 is made of ceramic material to resist high temperatures, and it covers the top surface of the burner part 100. Also, the top burner part 100 includes a plurality of burners 120 under the top plate 110 to generate heat from electricity. The burners 120 generally include coils. The coils are usually circular shaped and they radiate heat to a food container.

That is, heat generated from the burner 120 using electricity is radiated through the top plate 110 toward a food container filled with food to be cooked. Here, the heat is radiated only through a portion of the top plate 110 where the heater 120 is located, such that other portion of the top plate 110 is not heated. Therefore, careless users can be protected from injury.

The electric oven range further includes a control panel 200 on a rear top for controlling the operation of the electric oven range. The control panel 200 is formed integral with a rear surface of the electric oven range, and it includes a display 210 at a center portion to display operation state, time, temperature, etc. Also, the control panel 200 includes a plurality of control knobs 220 protruded from both sides of the display 210 for a user to control the operation of the electric oven range.

The control knobs 220 include knobs that are respectively corresponding to the burners 120 to control the burners 120 individually. Also, the control knobs include knobs to control the operations of an oven compartment 300 and a drawer 400. That is, each of the burner 120, oven compartment 300, and drawer 400 can be individually controlled.

The oven compartment 300 is located under the top burner part 100 for baking or roasting relatively large items. The oven compartment 300 is provided with a plurality of electric heaters to generate heat. The heat generated from the electric heaters increases the temperature of air in the oven compartment 300 and food in the oven compartment 300 is cooked by the heated air.

In detail, the food in the oven compartment 300 is cooked by radiant heat from the heaters, conductive heat from a heated metal plate, and convection of the heated air. With the oven compartment 300, relatively large items can be cooked and food can maintain its original taste and savor after cooking.

The oven compartment 300 includes an oven door 310 on a front side for selective opening and closing. The oven door 310 is hinged on the front side of the compartment 300 such that it can be rotated up and down for the opening and closing motions. The oven door 310 is formed with a protruded door handle 312 on a front top for a user to grasp.

Further, the oven compartment includes a transparent window 314 on a front center, such that a user can view the inside of the oven compartment to check cooking state. That is, a user can cook food while checking the cooking state through the transparent window 314.

The drawer 400 is installed under the oven compartment 300 to store cooked food at a warm temperature and heat up cool food. Sometimes, simple cooking can be carried out in the drawer 400. Therefore, the drawer 400 may be provided with a separate heater in a top portion or a bottom portion, or both the portions. Heat generated from the separate heater is directly radiated to food and also conducted to the food through a heated metal plate, such that the food can be stored at a warm temperature, heated up, and cooked in the drawer 400.

The drawer 400 is box-like shaped with open top, and includes a recessed drawer handle 410 in a front side for a user to grasp. The drawer 400 is slidably installed in the electric oven range, such that a user can open and close the drawer 400 by pulling and pushing the drawer 400.

Figure 2:
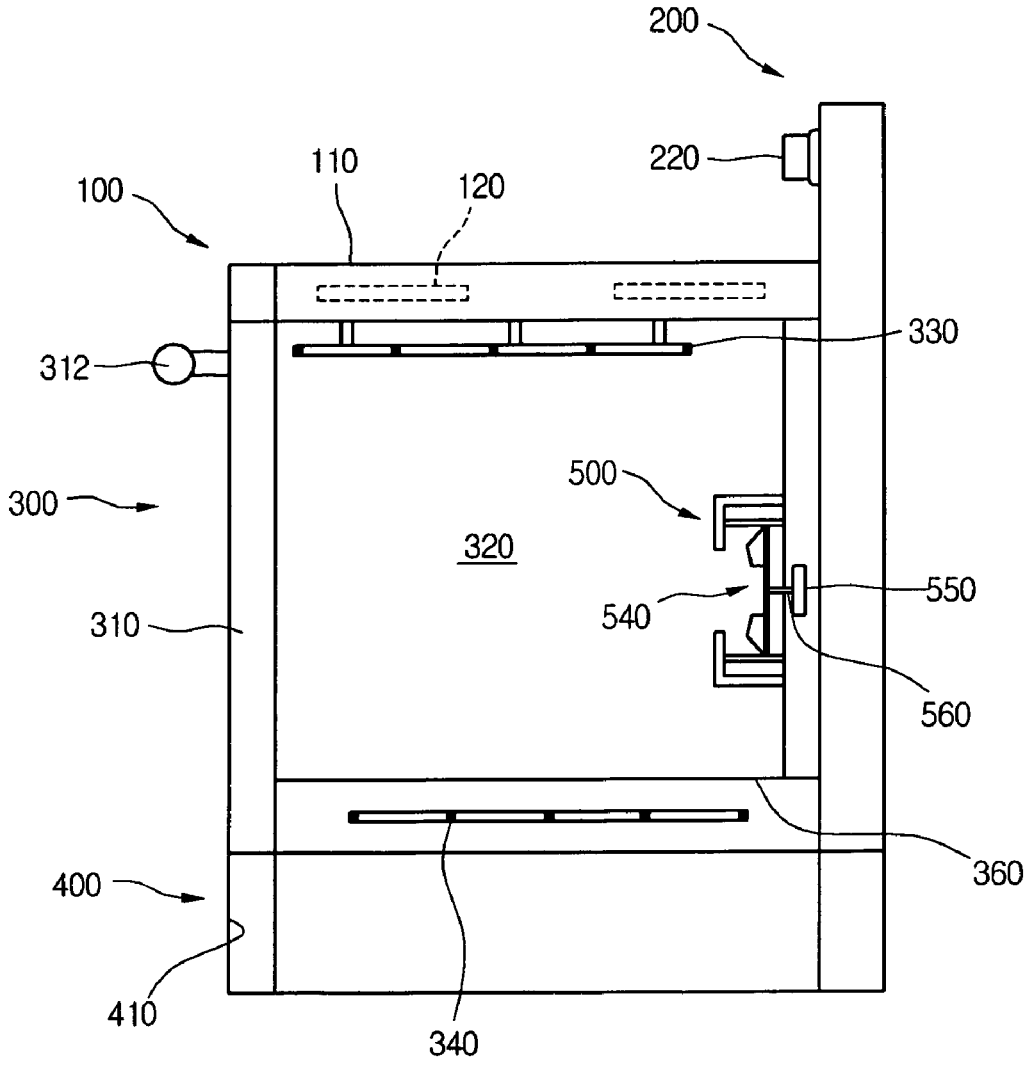
FIG. 2 is a schematic view of an electric oven range employing a convection part according to the present invention.
Figure 3:
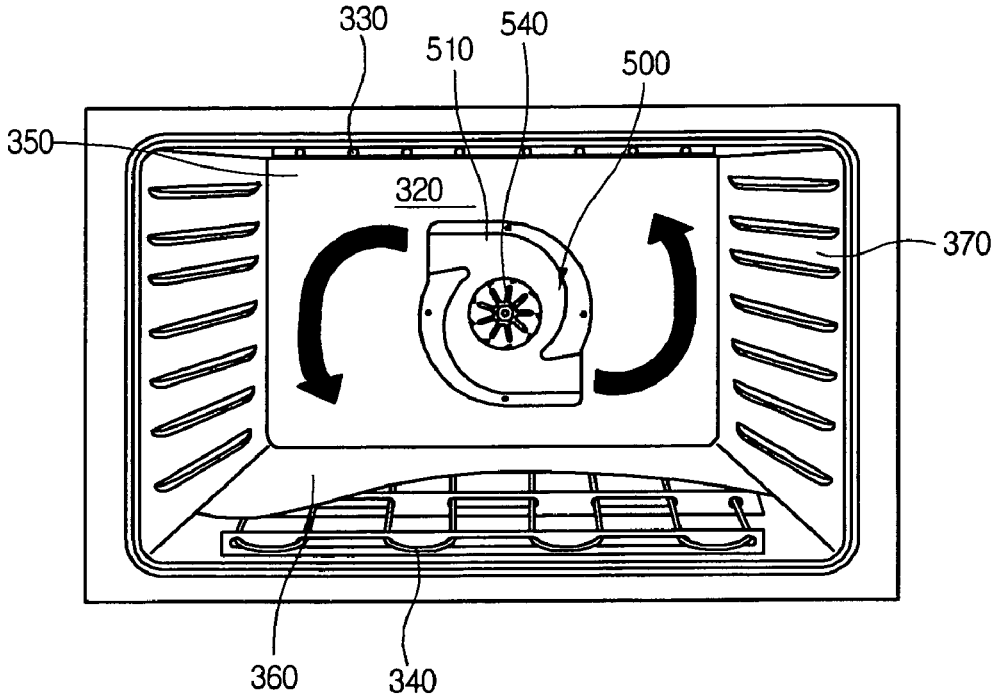
FIG. 3 shows an oven compartment employing a convection part according to the present invention.

FIG. 2 is a schematic view of an electric oven range employing a convection part according to the present invention, and FIG. 3 shows an oven compartment employing a convection part according to the present invention.

Referring to FIGS. 2 and 3, the oven compartment 300 defines an oven cavity 320 to receive food for cooking. The oven cavity 320 is box shape with open front, and the open front is selectively opened and closed by the oven door 310.

The oven cavity 320 includes plates such as a rear plate 350 on a rear surface, a bottom plate 360 on a bottom surface, and side plates 370 on both side surfaces. The plates may be integrally formed or attached using fasteners.

The oven cavity 320 further includes an upper heater 330 on an inner top surface to generate heat from electricity and a lower heater 340 under the bottom plate 360 to carry out the same function as the upper heater 330. That is, heat generated by the upper and lower heaters 330 and 340 is used to cook food in the oven cavity 320.

Though not shown, the rear plate 350 may include a temperature sensor to measure the temperature inside the oven compartment 300 and an oven lamp as an inside lighting unit to allow a user to see the inside of the oven compartment.

On the rear plate 350 formed on a rear side of the oven cavity 320, a convection part 500 is formed to circulate hot air heated from the heaters 330 and 340 by convection. The convection part 500 includes a convection fan 540 therein to circulate hot air through the oven cavity 320 to cook food evenly. The convection fan 540 will be more fully described later.

The convection part 500 further includes a fan housing 510 and other components. The fan housing 510 is protruded from a front of the rear plate 350 to enclose front and lateral sides of the convection fan 540.

That is, the convection part 500 includes the fan housing 510 protruded in a front direction to define an enclosed space and the convection fan 540 accommodated in the enclosed space to circulated air through the oven cavity 320. Further, the convection part 500 includes a convection motor 550 and a shaft 560. The convection motor 550 is installed on a back side of the rear plate 350 to generated rotary power from electricity, and the shaft 560 is connected between the convection motor 550 and the convection fan 540 through the rear plate 350.

As explained above, the convection part 500 includes the components to circulated hot air through the oven cavity 320 by convection to cook food placed in the oven cavity 320.

Figure 4:
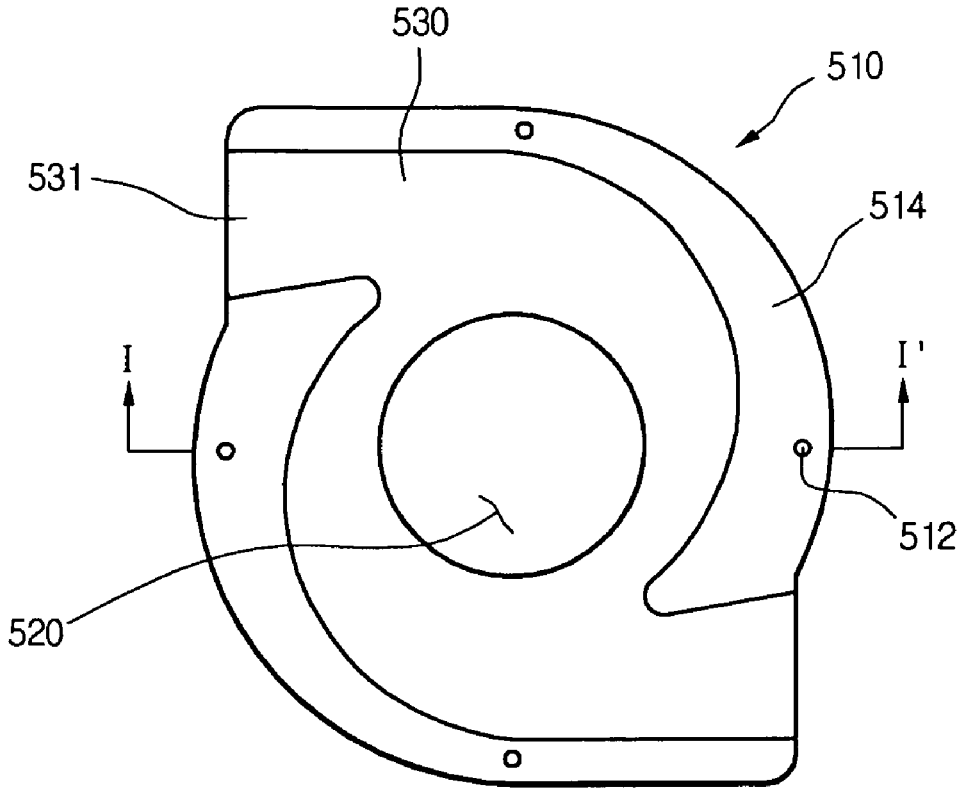
FIG. 4 shows a fan housing of a convection part according to the present invention.
Figure 5:
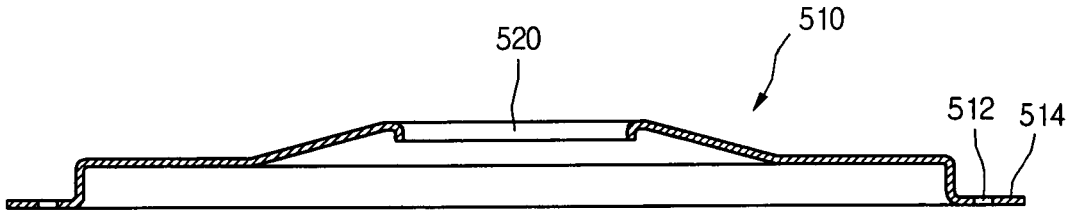
FIG. 5 is a sectional view taken along line I-I' in FIG. 4.

FIG. 4 shows a fan housing of a convection part according to the present invention, and FIG. 5 is a sectional view taken along line I-I' in FIG. 4.

Referring to FIGS. 4 and 5, the fan housing 510 includes an air intake 520 in a center portion to allow inflow of air.

The lateral surface of the fan housing 510 is coaxially with the air intake 520 and it has a predetermined height. The height of the fan housing 510 may be higher than that of the convection fan 540 to accommodate the convection fan 540 therein.

The fan housing 510 further includes discharge ducts 530 at up and down portions to discharge the air drawn through the air intake 520 by the convection fan 540 to the outside of the fan housing 510 (i.e., to the inside of the oven cavity 320).

The discharge ducts 530 are formed at the up and down portions of the fan housing 510. The upper discharge duct 530 discharges air in a left direction, and the lower discharge duct 530 discharges air in a right direction. The discharge ducts 530 define discharge holes 531 in exit ends, respectively. The discharge ducts 530 are formed in opposite directions, such that air discharged from the discharge holes 531 can be whirled in the oven cavity 320. Thus, heat convection can be evenly generated in the oven cavity 320 for a uniform temperature distribution in the oven cavity 320.

The fan housing 510 further includes a connecting flange 514 formed along an outer periphery of a lower end. The connecting flange 514 is bent from the lower end of the fan housing 510 in a radial direction, and it defines a plurality of screw holes 512 for fixing the fan housing 510 to a front side of the rear plate 350 with screws. The connecting flange 514 has a predetermined width. The fan housing 510 is coupled to a front side of the rear plate 350 by applying screws between the fan housing 510 and the rear plate 350 after contacting a bottom surface of the connecting flange 514 with a front surface of the rear plate 350.

Figure 6:
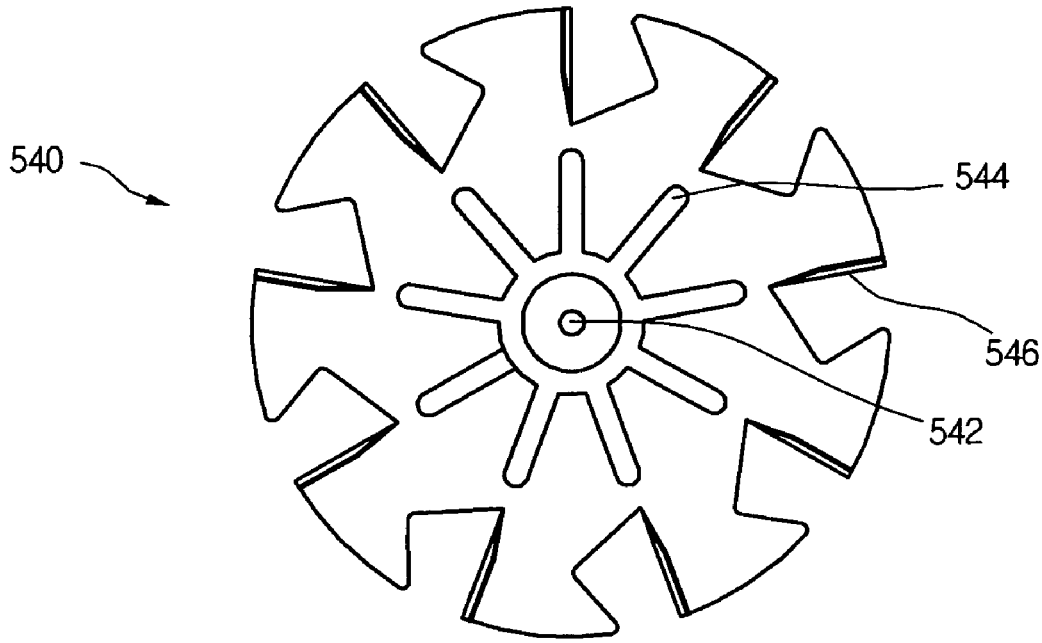
FIG. 6 is a plan view of a convection fan of a convection part according to the present invention.
Figure 7:
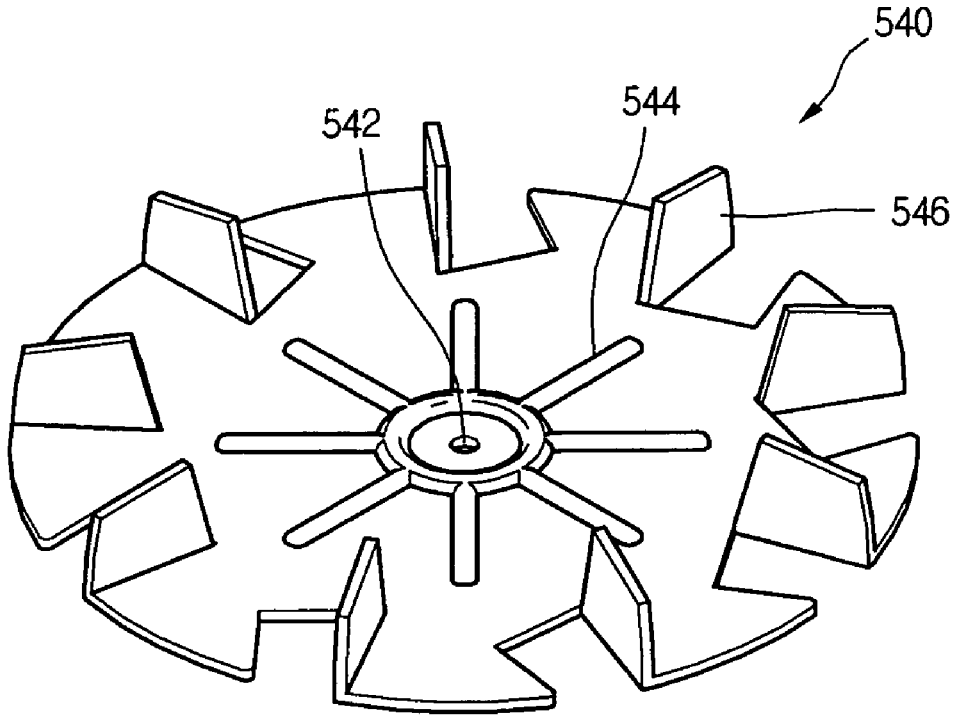
FIG. 7 is a perspective view of the convection fan depicted in FIG. 6.

FIG. 6 is a plan view of a convection fan of a convection part according to the present invention, and FIG. 7 is a perspective view of the convection fan depicted in FIG. 6.

Referring to FIGS. 6 and 7, the convection fan 540 is shaped like a circular plate shape, and it includes a coupling hole 542 at a center for coupling with the shaft 560 and a reinforcement bead 544 around the coupling hole 542 to increase strength. The reinforcement bead 544 is protruded from a surface of the convection fan 540, and it includes a circular portion at a center and a branch portion extended from the circular portion in radial directions.

The convection fan 540 further includes fan blades 546 that are formed by slitting an outer circumference inwardly. That is, each of the fan blades 546 is formed by slitting the outer circumference in an inclined direction and bending it. Therefore, the fan blades 546 and the convection fan 540 can be formed in one piece. The fan blades 546 are arranged at an angle to each other, such that air circulation can be increased more smoothly due to increased effective surface area.

The plurality of fan blades 546 are formed along the outer circumference of the convection fan 540 by slitting and bending processes. As a result, the convection fan 540 includes slots having the same shape with the fan blades 546. Also, the fan blades 546 are formed outside the reinforcement bead 544.

Hereinafter, an operation of the electric oven range will be described. First, an operation of the top burner part 100 will now be described. A user can turn on the burner 120 using the control knob 220 of the control panel 200 after placing a food container filled with food on the top plate 110.

When the burner 120 is turned on, heat is generated from the burner 120 and transferred to the food container through the top plate 110. That is, heat generated from the burner 120 is radiated to the food container and conducted to the food through the food container, such that the top burner part 100 can cook food.

Secondly, an operation of the oven compartment 300 will now be described. A use can rotate down the oven door 310 to open the oven compartment 300 by pulling the door handle 312. Then, the user can put food into the oven cavity 320 from the opened front. After placing the food in the oven cavity 320, the user can close the oven compartment 300 by rotating up the oven door 310.

After that, the user can turn on the plurality of burners, the upper heaters 330 and lower heaters 340, installed in the oven compartment 300 using the control knob 220 of the control panel 200. When turned on, the plurality of heaters generate heat from supplied electricity.

The heat generated from the plurality of heaters increases the temperature of the closed oven cavity 320 for cooking the food. With the increase of the inside temperature of the oven cavity 320, the food in the oven cavity 320 can be cooked.

Also, the convection motor 550 installed on a back side of the rear plate 350 is rotated. Upon the rotation of the convection motor 550, the convection fan 540 connected with the convection motor 550 through the shaft 560 is also rotated. The suction force of the convection fan 540 draws air from the oven cavity 320 into the fan housing 510 through the air intake 520 defined in the center of the fan housing 510.

The drawn air is directed to the discharge ducts 540 in a radial direction by the convection fan 540, and then it is discharged outside of the fan housing 510 (i.e., back to the oven cavity).

The discharged air is circulated through the oven cavity 320 by the blowing force of the convection fan 540. With this air circulation in the oven cavity 320, heat can be transferred by convection. Therefore, the temperature inside the oven cavity can be kept uniformly and thus the food in the oven cavity 320 can be cooked evenly.

It will be apparent to those skilled in the art that various modifications and variations can be made in the present invention. Thus, it is intended that the present invention covers the modifications and variations of this invention provided they come within the scope of the appended claims and their equivalents.

For example, the fan housing can be designed to discharge air in left-upper and right-lower directions, instead of discharging the air in left and right directions.

According to the present invention, the convection part is formed with the discharge ducts on both sides, such that air discharged from the convection part can be whirled in the oven cavity. Thus, heat convection can be smoothly created to uniformly maintain the temperature inside of the oven cavity. Therefore, food can be evenly cooked in the oven cavity with increased efficiency and less time.

Further, since the discharge ducts are formed on both sides of the convection part, the sizes of the discharge ducts can be increased. Therefore, air can flow in the convection part more smoothly and it can be discharged from the convection part more smoothly.

What is claimed is:

1. A convection apparatus of an oven range, comprising:

a motor;

a convection fan connected with the motor; and a fan housing, the fan housing having a lateral wall surrounding a lateral circumference of the convection fan, the fan housing including at least one pair of discharge ducts in opposite directions, the lateral wall of the fan housing having at least one pair of openings respectively being air outlets of the at least one pair of discharge ducts, the one pair of openings directly facing an oven cavity of the oven range to directly output air in the at least one pair of discharge ducts into the oven cavity of the oven range, one of the one pair of openings facing to a first direction, the other one of the one pair of openings facing to a second direction opposite to the first direction, wherein each of the discharge ducts is circular shaped with an increasing distance from a center of the fan housing to the discharge duct as the discharge duct goes from one end to the other end.

2. The convection apparatus according to claim 1, wherein the discharge ducts are respectively formed on both sides of the fan housing to discharge air in lateral directions.

3. The convection apparatus according to claim 1, wherein the convection fan includes a fan blade having a bent portion.

4. The convection apparatus according to claim 3, wherein a plurality of the fan blades are provided.

5. The convection apparatus according to claim 3, wherein the fan blade is located along an outer periphery of the convection fan.

6. The convection apparatus according to claim 1, wherein the discharge ducts are integrally formed with the fan housing.

7. The convection apparatus according to claim 1, wherein a distance from a center of the fan housing to the lateral wall of the fan housing increases when the lateral wall of the fan housing approaches the openings of the lateral wall.

8. The convection apparatus according to claim 1, wherein air is discharged from the discharge ducts in a tangential direction of the convection fan into an oven cavity of the oven range.

9. The convection apparatus according to claim 1, wherein the fan housing has an air intake at a front surface of the fan housing, and the front surface has a down-sloping portion extending from the air intake.

10. A convection apparatus of an oven range, the oven range having an oven cavity in which food is to be cooked and the convection apparatus at a rear side of the oven cavity, the convection apparatus comprising:

a motor generating rotary motion;

a convection fan rotated by the rotary motion to circulate air and including a plurality of fan blades; and a fan housing, the fan housing having a lateral wall surrounding a lateral circumference of the convection fan, the fan housing including at least one pair of discharge ducts to discharge air, the lateral wall of the fan housing having at least one pair of openings respectively being air outlets of the at least one pair of discharge ducts, the one pair openings directly facing the oven cavity of the oven range to directly output air in the at least one pair of discharge ducts into the oven cavity of the oven range, one of the one pair of openings facing to a first direction, the other one of the one pair of openings facing to a second direction opposite to the first direction, wherein each of the discharge ducts is circular shaped with an increasing distance from a center of the fan housing to the discharge duct as the discharge duct goes from one end to the other end.

11. The convection apparatus according to claim 10, wherein the fan blades are located along an outer periphery of the convection fan.

12. The convection apparatus according to claim 10, wherein the discharge ducts are formed in opposite directions with respect to each other to discharge the air in opposite directions.

13. The convection apparatus according to claim 12, wherein the discharge ducts are respectively formed on both sides of the fan housing to discharge air in lateral directions.

14. The convection apparatus according to claim 10, wherein the discharge ducts are integrally formed with the fan housing.

15. The convection apparatus according to claim 10, wherein the fan housing includes a raised front center portion that is sloped up from a periphery to a center.

16. The convection apparatus according to claim 10, wherein the fan housing defines an air intake at a center to guide air suction from the oven cavity.

17. The convection apparatus according to claim 10, wherein the convection fan defines a coupling hole at a center to receive an end of a shaft for receiving the rotary motion from the motor.

18. The convection apparatus according to claim 10, wherein the discharge ducts are injection molded integrally with the fan housing.

19. The convection apparatus according to claim 10, wherein a distance from a center of the fan housing to the lateral wall of the fan housing increases when the lateral wall of the fan housing approaches the openings of the lateral wall.

20. The convection apparatus according to claim 10, wherein the air is discharged from the discharge ducts in a tangential direction of the convection fan into an oven cavity of the oven range.

21. The convection apparatus according to claim 10, wherein the fan housing has an air intake at a front surface of the fan housing, and the front surface has a down-sloping portion extending from the air intake.

22. The convention apparatus according to claim 10, wherein the convention fan and the fan housing are located in the oven cavity.

23. A convection apparatus of an oven range, comprising:

a convection fan;

a motor for driving the convection fan;

a shaft connected to the motor and the convection fan;

a fan housing, the fan housing having a lateral wall surrounding a lateral circumference of the convection fan, the lateral wall of the fan housing having at least one opening; and at least one discharge duct formed at the fan housing, the at least one opening on the lateral wall of the fan housing being an air outlet of the at least one discharge duct, the at least one opening directly facing an oven cavity of the oven range to directly output air in the at least one discharge duct into the oven cavity of the oven range, the at least one opening facing to a first direction substantially perpendicular to the shaft, wherein each of the discharge ducts is circular shaped with an increasing distance from a center of the fan housing to the discharge duct as the discharge duct goes from one end to the other end.

24. The convection apparatus according to claim 23, wherein the at least one discharge duct includes a plurality of discharge ducts in opposite directions with respect to each other.

25. The convection apparatus according to claim 23, wherein a distance from a center of the fan housing to the lateral wall of the fan housing increases when the lateral wall of the fan housing approaches the opening of the lateral wall.

26. The convection apparatus according to claim 23, wherein air is discharged from the discharge duct in a tangential direction of the convection fan into an oven cavity of the oven range.

27. The convection apparatus according to claim 23, wherein the fan housing has an air intake at a front surface of the fan housing, and the front surface has a down-sloping portion extending from the air intake.

28. A convection apparatus of an oven range, comprising:

a motor;

a convection fan connected with the motor; and a fan housing, the fan housing having a lateral wall surrounding a lateral circumference of the convection fan, the fan housing including at least one pair of discharge ducts in opposite directions, the lateral wall of the fan housing having at least one pair of openings respectively being air outlets of the at least one pair of discharge ducts, wherein each of the discharge ducts is circular shaped with an increasing distance from a center of the fan housing to the discharge duct as the discharge duct goes from one end to the other end, wherein the sectional area of the discharge ducts increases as going toward the openings.

29. A convection apparatus of an oven range, the oven range having an oven cavity in which food is to be cooked and the convection apparatus at a rear side of the oven cavity, the convection apparatus comprising:

a motor generating rotary motion;

a convection fan rotated by the rotary motion to circulate air and including a plurality of fan blades; and a fan housing, the fan housing having a lateral wall surrounding a lateral circumference of the convection fan, the fan housing including at least one pair of discharge ducts to discharge air, the lateral wall of the fan housing having at least one pair of openings respectively being air outlets of the at least one pair of discharge ducts, wherein each of the discharge ducts is circular shaped with an increasing distance from a center of the fan housing to the discharge duct as the discharge duct goes from one end to the other end, wherein the sectional area of the discharge ducts increases as going toward the openings.

30. A convection apparatus of an oven range, comprising:

a convection fan;

a fan housing, the fan housing having a lateral wall surrounding a lateral circumference of the convection fan, the lateral wall of the fan housing having at least one opening; and at least one discharge duct formed at the fan housing, the at least one opening on the lateral wall of the fan housing being an air outlet of the at least one discharge duct, wherein each of the discharge ducts is circular shaped with an increasing distance from a center of the fan housing to the discharge duct as the discharge duct goes from one end to the other end, wherein the sectional area of the discharge duct increases as going toward the openings.

* * * * *